US006309277B1

(12) United States Patent
Arcayan et al.

(10) Patent No.: US 6,309,277 B1
(45) Date of Patent: Oct. 30, 2001

(54) SYSTEM AND METHOD FOR ACHIEVING A DESIRED SEMICONDUCTOR WAFER SURFACE PROFILE VIA SELECTIVE POLISHING PAD CONDITIONING

(75) Inventors: Rigel G. Arcayan, Round Rock; Jose M. Pineda-Garcia; Michael K. Burleson, both of Austin, all of TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/261,267

(22) Filed: Mar. 3, 1999

(51) Int. Cl.[7] ..... B24B 49/00; B24B 51/00

(52) U.S. Cl. ..... 451/8; 451/10; 451/21; 451/72

(58) Field of Search ..... 438/691, 692, 438/693; 451/8, 10, 11, 21, 56, 72, 443

(56) References Cited

U.S. PATENT DOCUMENTS

| | | | | |
|---|---|---|---|---|
| 5,538,460 | * | 7/1996 | Onodera | 451/72 |
| 5,609,718 | * | 3/1997 | Meikle . | |
| 5,974,679 | * | 11/1999 | Birang et al. | 451/433 X |
| 6,040,244 | * | 3/2000 | Arai et al. | 438/691 |
| 6,045,434 | * | 4/2000 | Fisher, Jr. et al. | 451/6 |
| 6,194,231 | * | 2/2001 | Ho-Cheng et al. | 451/6 X |

* cited by examiner

*Primary Examiner*—Timothy V. Eley
(74) *Attorney, Agent, or Firm*—Kevin L. Daffer; Conley, Rose & Tayon P.C.

(57) ABSTRACT

A system and method are presented for selectively conditioning a surface of a polishing pad of a CMP apparatus in order to achieve a desired surface profile of a semiconductor wafer. The semiconductor wafer may be subjected to a CMP operation using the CMP apparatus following the conditioning. The present CMP apparatus includes a polishing pad having an underside surface mechanically coupled to a substantially planar surface of a platen, an abrasive surface, and a measurement system. The platen and abrasive surface may be rotatable about respective rotational axes. The present conditioning method includes selecting a region of an upper "polishing" surface of the polishing pad (e.g., a CMP region) encircling a rotational axis of the platen and bounded by first and second radial distances from the rotational axis of the platen. An existing first radial profile of the polishing surface within the selected region may be determined using the measuring system, and a desired second radial profile of the polishing surface within the selected region may be chosen based upon the desired surface profile of the semiconductor wafer. During the conditioning, the abrasive surface may contact the polishing surface within the selected region at a radial distance from the rotational axis of the platen dependent upon the existing first and desired second radial profiles of the polishing surface such that the desired second radial profile is achieved during the conditioning.

9 Claims, 9 Drawing Sheets

SYSTEM AND METHOD FOR ACHIEVING A DESIRED SEMICONDUCTOR WAFER SURFACE PROFILE VIA SELECTIVE POLISHING PAD CONDITIONING

BACKGROUND OF THE INVENTION

1. Field of the Invention

This invention relates to semiconductor wafer fabrication, and more particularly to a system and method for selectively conditioning a surface of a polishing pad of a chemical-mechanical polishing ("CMP") apparatus in order to achieve a desired surface profile of a semiconductor wafer subsequently subjected to CMP using the CMP apparatus.

2. Description of Related Art

During a wafer fabrication process, multiple integrated circuits are formed upon frontside surfaces of each of several semiconductor wafers processed as a group or lot. Each integrated circuit consists of electronic devices electrically coupled by conductive traces called interconnects. Interconnects are patterned from conductive layers formed on the surface of a semiconductor wafer. The ability to form stacked layers of interconnects has allowed more complex circuits to be implemented in and on relatively small surface areas of semiconductor substrates. The individual interconnect levels of multilevel interconnect structures are separated by layers of electrically insulating materials (i.e., interlevel dielectric layers).

As the number of interconnect levels is increased, the stacking of additional interconnect layers on top of one another tends to increase the elevational disparities in frontside surface topographies. Problems arise when attempting to form interconnects upon rugged frontside surface topographies. Abrupt elevational changes in the frontside surface topography of a semiconductor wafer typically occur at or near lateral edges of underlying patterned features, e.g., interconnects. The tendency of layers formed upon the surface topography of a semiconductor wafer to be thinner over such abrupt elevations changes (i.e., "steps") is referred to as the "step coverage" problem. In additional to the step coverage problem, large and abrupt elevation disparities lead to depth of focus problems. Depth of focus problems become an issue during the lithographic process in which layers are patterned across a semiconductor topography. A major factor in the processing of integrated circuits with submicron device dimensions is the limited depth of focus of the optical steppers used to pattern circuit features. In order to obtain maximum resolutions, imaging surfaces must be fairly planar with a suitable elevational disparity less than about 0.5 microns. Accordingly, interlevel dielectric planarization techniques must be employed in order to make imaging surfaces substantially planar.

Chemical-mechanical polishing/planarization ("CMP") is a popular method of planarizing the upper surface of a layer (e.g., a dielectric or conductive layer) formed upon the frontside surface of a semiconductor wafer. CMP combines chemical etching and mechanical buffing to remove raised features upon the frontside surface of the semiconductor wafer. FIGS. 1 and 2 will now be used to describe an exemplary CMP apparatus. FIG. 1 is a top plan view of the exemplary CMP apparatus 10, and FIG. 2 is a side elevation view of exemplary CMP apparatus 10. CMP apparatus 10 is representative of, for example, a model Auriga or CMP-V polisher made by SpeedFam International, Inc. (Chandler, Ariz.). CMP apparatus 10 includes a platen (i.e., rotatable table) 12, a polishing pad 14, a wafer carrier or "chuck" 16, and a slurry delivery system 18.

As shown in FIG. 2, polishing pad 14 may include two separate disk-shaped polishing pads 14*a* and 14*b* stacked vertically upon one another. An underside surface of a first polishing pad 14*a* may be attached (e.g., adhesively) to a substantially planar upper surface of platen 14. A second polishing pad 14*b* may be attached (e.g., adhesively) to an upper surface of polishing pad 14*a*. Polishing pad 14*a* may be made of, for example, a rigid, microporous polyurethane material (e.g., a model IC1000 polishing pad made by Rodel, Newark, Del.). Polishing pad 14*b* may be made of, for example, a polyurethane-impregnated polyester felt material (e.g., a model Suba IV polishing pad made by Rodel).

Polishing pads 14*a* and 14*b* have outer diameters "O.D.", and may be stacked as shown in FIG. 2 such that their outer diameters are vertically aligned. As shown in FIG. 2, polishing pad 14*b* has a hole in the center, and accordingly has an inner diameter "I.D.". Polishing pad 14*b* also has a center line "C" midway between outer diameter "O.D." and inner diameter "I.D." as shown in FIG. 2.

During operation of exemplary CMP apparatus 10, a semiconductor wafer 20 is placed within wafer chuck 16. Platen 12 is set into rotational motion about a rotational axis 22 normal to the substantially planar surface. Wafer chuck 16 is set into rotational motion about a rotational axis 24. A force "F" is applied between wafer chuck 16 and platen 12 as shown in FIG. 2, pressing a frontside surface of semiconductor wafer 20 against the rotating upper surface of polishing pad 14 (i.e., polishing pad 14*b*). Slurry delivery system 18 delivers a liquid slurry to polishing pad 14, saturating polishing pad 14 with the liquid slurry. The liquid slurry may contain, for example, abrasive particles and a mild etchant chemical which softens or catalyzes the exposed material at the frontside surface of semiconductor wafer 20. Elevationally extending portions of the frontside surface of semiconductor wafer 20 are removed by combined chemical softening of the exposed surface material and physical abrasion brought about by relative movement between polishing pad 14 and the frontside surface of semiconductor wafer 20.

When used to planarize a semiconductor wafer surface, CMP apparatus 10 has two important performance factors: (i) polishing removal rate, and (ii) resultant semiconductor wafer surface planarity or "uniformity". A high polishing rate is desirable in order to maximize the number of wafers which may be planarized in a given amount of time. A high measure of resultant semiconductor wafer surface planarity or "uniformity" is also desirable in order to reduce the step coverage and depth of focus problems described above.

The polishing rate performance of CMP apparatus 10 becomes degraded as waste materials build up on the upper surface of polishing pad 14 (i.e., polishing pad 14*b*) during use. The waste materials smooth out the textured upper surface of the pad, reducing the effectiveness of polishing pad 14. In order to maintain the effectiveness of polishing pad 14, the upper surface of polishing pad 14 is typically renewed periodically using a conditioning operation.

FIG. 3 is a side elevation view of CMP apparatus 10 wherein polishing pad 14 is undergoing an exemplary conditioning operation. The conditioning operation employs a pad conditioner 26 having a substantially planar abrasive surface 28. Abrasive surface 28 may include abrasive particles (e.g., diamond particles) embedded therein. During conditioning, platen 12 is set into rotational motion about rotational axis 22, and pad conditioner 26 is set into rotational motion about a rotational axis 30 normal to substantially planar abrasive surface 28. Abrasive surface 28 of pad conditioner 26 is brought into contact with the upper surface of polishing pad 14 (i.e., polishing pad 14*b*). As a result, a portion of the upper surface of polishing pad 14 is abraded (i.e., removed), along with any waste materials built up on the upper surface of polishing pad 14.

The semiconductor wafer surface planarizing or "uniformity" performance of CMP apparatus 10 is dependent upon the planarity of the upper surface of polishing pad 14. Past efforts to assess the uniformity performance of CMP apparatus 10 following the conditioning of polishing pad 14 include using CMP apparatus 10 to polish a surface of one or more "qualification" wafers. Thicknesses of one or more layers formed upon the surfaces of the qualification wafers are then measured at various locations about the surfaces in order to determine the surface planarities of the qualification wafers. Such testing is not only time consuming, it is also wasteful in terms of material. The latter is especially true if the qualification wafers have operational circuits formed thereupon and the surface planarities of the polished wafers are unacceptable.

FIG. 4 is a sectional view of a portion of exemplary CMP apparatus 10 as indicated in FIG. 1. Past efforts to assess the uniformity performance of CMP apparatus 10 following the conditioning of polishing pad 14 also include attempts to assess the planarity of the upper surface of polishing pad 14 by measuring and comparing height "$h_1$" of polishing pad 14*b* above the upper surface of polishing pad 14*a* at inner diameter "I.D." and height "$h_2$" of polishing pad 14*b* above the upper surface of polishing pad 14*a* at outer diameter "O.D." as shown in FIG. 4. Height "$h_1$" of polishing pad 14*b* above the upper surface of polishing pad 14*a* may be easily measured using a micrometer (e.g., a dial gage).

On the other hand, measuring height "$h_2$" of polishing pad 14*b* requires either: (i) separating a portion of polishing pad 14*b* from the upper surface of polishing pad 14*a* long enough to measure height "$h_2$", or (ii) removing a portion of polishing pad 14*b* (e.g., cutting a notch or hole in polishing pad 14*b*)about outer diameter "O.D." in order to measure height "$h_2$". Separating polishing pad 14*b* from the upper surface of polishing pad 14*a*, as well as removing any portion of polishing pad 14*b*, may reduce the polishing performance of polishing pad 14, and is thus undesirable. The above measurement method also assumes that the upper surface of polishing pad 14*a* underlying polishing pad 14*b* remains planar, which may or may not be true.

It would thus be desirable to have a method for determining the surface planarizing or "uniformity" performance of a CMP apparatus, following conditioning of a polishing pad of the CMP apparatus, which does not include separating the polishing pad from an underlying surface or removing any portion of the polishing pad.

SUMMARY OF THE INVENTION

The problems outlined above are in large part solved by a system and method for selectively conditioning a surface of a polishing pad of a CMP apparatus in order to achieve a desired surface profile of a semiconductor wafer. The semiconductor wafer is subjected to a CMP operation using the CMP apparatus following the conditioning. A CMP apparatus is described including a polishing pad having an underside surface mechanically coupled to a substantially planar surface of a platen. The platen is rotatable about a rotational axis normal to the substantially planar surface. The CMP apparatus also includes a substantially planar abrasive surface rotatable about a rotational axis normal to the abrasive surface. The abrasive surface may include abrasive particles (e.g., diamond particles) embedded therein.

A method for conditioning an upper surface (i.e., a polishing surface) of the polishing pad includes selecting a region of the polishing surface extending between a first and second radial distances from the rotational axis of the platen. The "selected region", encircling the rotational axis of the platen and bounded by the first and second radial distances, may be the region in which CMP is performed.

An existing first "radial profile" of the polishing surface within the selected region is determined. The term "radial profile" is used to describe a profile along a radial emanating from the rotational axis of the platen. A radial profile of the polishing surface "within the selected region" extends along a radial and between the first and second radial distances defining the selected region. The radial profile exists in a plane perpendicular to the substantially planar surface of the platen and containing the rotational axis of the platen.

The determining of the existing first radial profile of the polishing surface within the selected region may include: (i) measuring a first existing distance between the polishing surface and the surface of the platen at the first radial distance from the rotational axis of the platen, and (ii) measuring a second existing distance between the polishing surface and the surface of the platen at the second radial distance from the rotational axis of the platen. The determining may reveal the extent to which the radial profile of the polishing surface within the selected region is "slanted upwardly" in a radial direction with respect to the substantially planar surface of the platen, "flat" with respect to the substantially planar surface of the platen, or "slanted downwardly" in a radial direction with respect to the substantially planar surface of the platen.

A desired second radial profile of the polishing surface within the selected region may be chosen, including: (i) a first desired distance between the polishing surface and the surface of the platen at the first radial distance from the rotational axis of the platen, and (ii) a second desired distance between the polishing surface and the surface of the platen at the second radial distance from the rotational axis of the platen. The first and second desired distances may determine the extent to which the radial profile of the polishing surface within the selected region is desired to be "slanted upwardly" in a radial direction with respect to the substantially planar surface of the platen, to be "flat" with respect to the substantially planar surface of the platen, or to be "slanted downwardly" in a radial direction with respect to the substantially planar surface of the platen. A correspondence between the radial profile of the polishing surface and the surface profile of the semiconductor wafer following CMP is established herein, and may be used as a basis for choosing the desired second radial profile of the polishing surface.

Conditioning of the polishing surface may involve rotating the platen and the abrasive surface about their respective rotational axes. The abrasive surface and the polishing surface may then brought into contact such that the polishing surface is abraded. The abrasive surface may be positioned such that the rotational axis of the abrasive surface is parallel to and a third radial distance from the rotational axis of the platen. The third radial distance may be constrained to lie between the first and second radial distances such that the selected region of the polishing surface is conditioned.

The third radial distance between the rotational axes of the abrasive surface and the platen may be selected dependent upon the existing first and desired second radial profiles of the polishing surface such that the desired second radial profile of the polishing pad is achieved during the conditioning. For example, when a difference between the second existing distance and the second desired distance is greater than a difference between the first existing distance and the and first desired distance, the third radial distance may be made greater than a radial distance midway between the first and second radial distances. In this case, a larger rotating surface area of the abrasive surface is in contact with an outer radial portion of the selected region. As a result, more material is removed from the outer radial portion of the selected region than an inner radial portion of the selected region. The contact between the abrasive surface and the polishing surface may be continued until the desired second radial profile is achieved within the selected region.

When a difference between the second existing distance and the second desired distance is equal to a difference between the first existing distance and the first desired distance, the third radial distance may be made equal to the radial distance midway between the first and second radial distances. In this case, equal rotating surface areas of the abrasive surface contact the inner and outer portions of the selected region. As a result, equal amounts of material are removed from the inner and outer portions of the selected region, and the radial profile of the polishing surface within the selected region is not changed.

When a difference between the second existing distance and the second desired distance is less than a difference between the first existing distance and first desired distance, the third radial distance may be made less than the radial distance midway between the first and second radial distances. In this case, a larger rotating surface area of the abrasive surface is in contact with the inner radial portion of the selected region. As a result, more material is removed from the inner radial portion of the selected region than the outer portion. The contact between the abrasive surface and the polishing surface may be continued until the desired second radial profile is achieved within the selected region.

A third existing distance between the polishing surface and the surface of the platen at the radial distance midway between the first and second radial distances may also be measured used to determine if the polishing pad is eligible for conditioning. It has been empirically determined that conditioning of the polishing pad to achieve a desired radial profile is most effective when the third existing distance lies between the first and second existing distances. Conditioning to achieve a desired radial profile is least effective when the third existing distance is not between the first and second existing distances. In this case, the polishing pad should be replaced.

The present CMP apparatus may include a measurement system for measuring a distance between the polishing surface and the substantially planar surface of the platen. The measurement system may include a sensor connected to a measurement unit by a cable. The sensor may produce a signal dependent upon a distance between a sensing surface of the sensor and the substantially planar surface of the platen, wherein the sensing surface may be placed in contact with the polishing surface. The cable may transmit the signal produced by the sensor to the measurement unit. The measurement unit may include a display device for displaying the distance between the sensing surface and the substantially planar surface of the platen. Alternately, the measurement unit may include signal conditioning circuitry, and may produce an output signal (e.g., an electrical voltage or current) proportional to the distance between the sensing surface and the substantially planar surface of the platen. The measurement unit may produce the output signal at an output port configured for connecting to a device for measuring the signal (e.g., a voltmeter or ammeter).

The platen may be formed from an electrically conductive metal (e.g., stainless steel), and the polishing pad may be made of an electrically non-conductive material (e.g., a polyurethane material or a polyurethane-impregnated polyester felt material). In this case, the sensor may include a coil of wire, and the measurement system may inductively measure the distance between the sensing surface of the sensor and the substantially planar surface of the platen through the electrically non-conductive polishing pad. The measurement unit may produce an electrical voltage proportional to the distance between the sensing surface of the sensor and the substantially planar surface of the platen at an output port.

The polishing pad may include stacked first and second polishing pads, wherein an underside surface of the first polishing pad is mechanically coupled to the to the substantially planar surface of the platen, and wherein an underside surface of the second polishing pad is mechanically coupled to an upper surface of the first polishing pad. The second polishing pad may have a hole in a center portion, and may have an upper surface which extends between the first and second radial distances from the rotational axis of the platen. The upper surface of the second polishing pad may be the selected region of the polishing pad.

BRIEF DESCRIPTION OF THE DRAWINGS

Other objects and advantages of the invention will become apparent upon reading the following detailed description and upon reference to the accompanying drawings in which.

Figure 1:
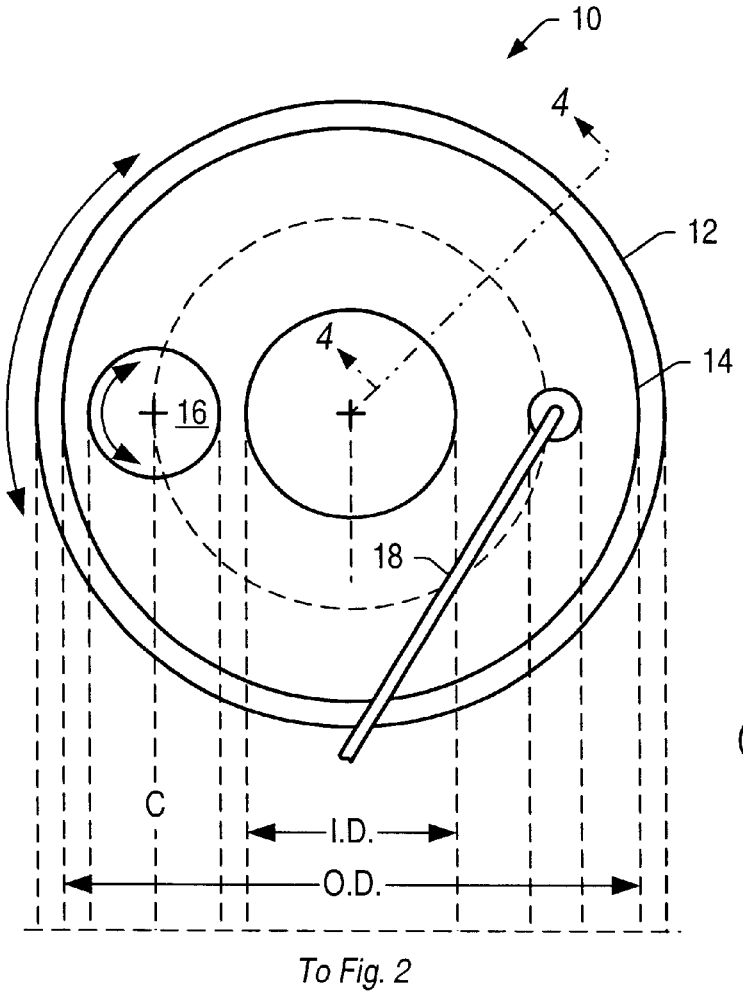
Fig. 1 (Prior Art)
FIG. 1 is a top plan view of an exemplary CMP apparatus including a polishing pad attached to a substantially planar surface of a platen, wherein during a CMP operation a surface of a semiconductor wafer is pressed against an upper surface of the polishing pad.
Figure 2:
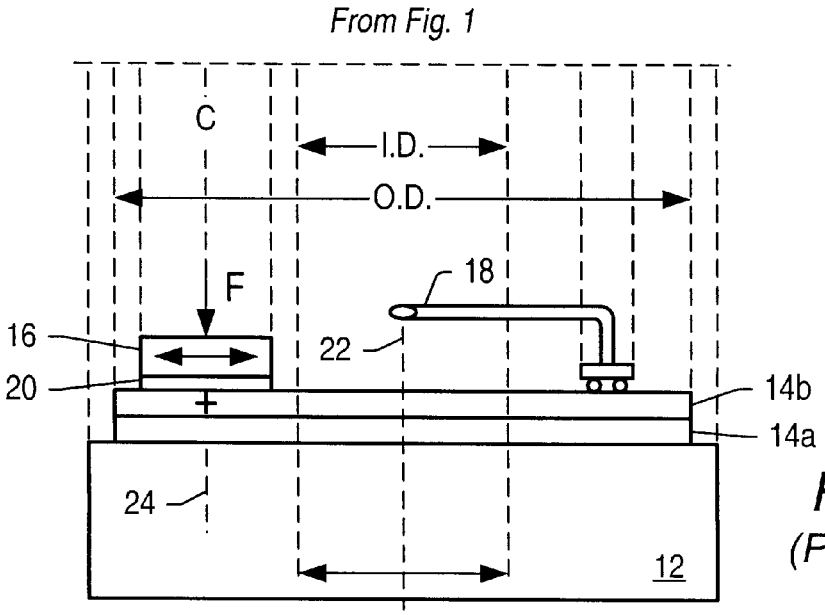
Fig. 2 (Prior Art)
FIG. 2 is a side elevation view of the exemplary CMP apparatus of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

FIGS. 5*a–c*, 6*a–c*, and 7*a–c* will now be used to describe an empirically-derived relationship between a radial profile of the upper surface of polishing pad 14 and a surface profile of semiconductor wafer 20 polished using polishing pad 14. As used herein, the term "radial profile" is used to describe a profile along a radius. The radial profile of the upper surface of polishing pad 14 is the profile of the upper surface of polishing pad 14 along a radial emanating from rotational axis 22 of platen 12. The radial profile of the upper surface of polishing pad 14 exists in a plane perpendicular to the substantially planar surface of platen 12 and containing rotational axis 22 of platen 12.

Figure 4:
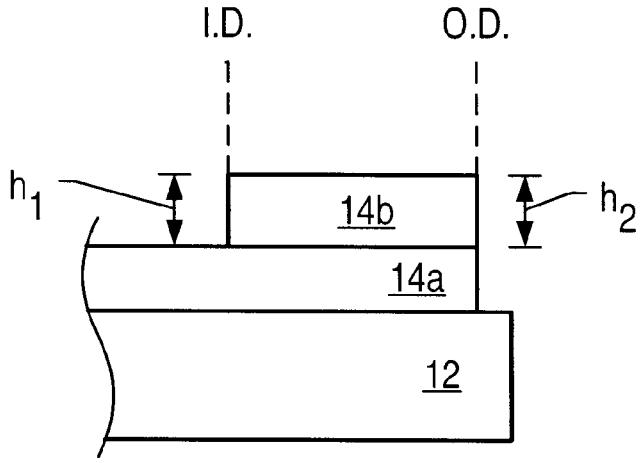
Fig. 4 (Prior Art)
FIG. 4 is a sectional view of a portion of the exemplary CMP apparatus of FIG. 1.
Figures 5A, 5B, 5C, 6A, 6B, 6C, 7A, 7B, 7C:
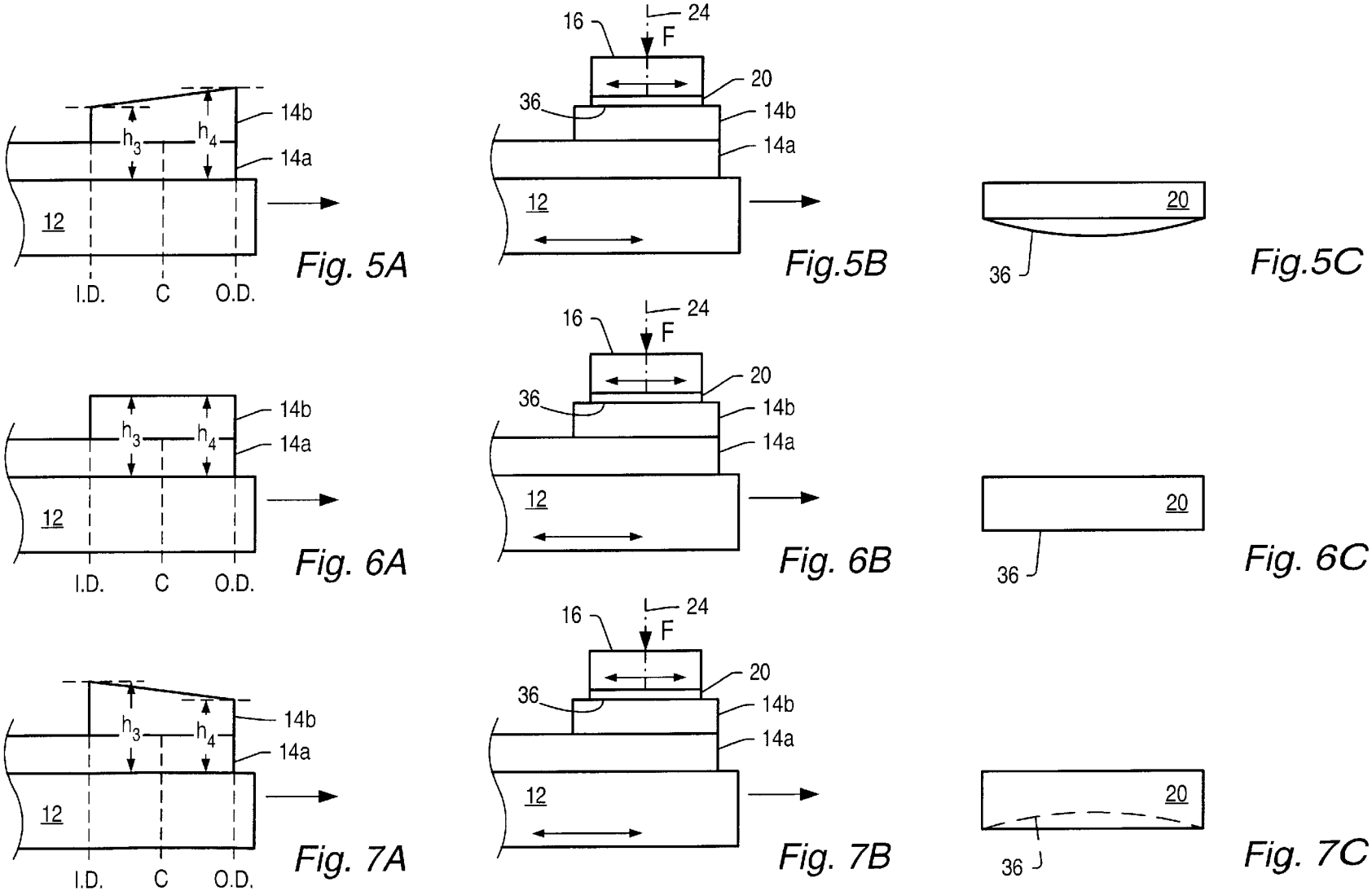
FIG. 5*a* is the sectional view of FIG. 4 wherein the upper surface of the polishing pad has a radial profile which is "slanted upwardly" in a radial direction from a rotational axis of the platen and between a first and second radial distances defining a "selected region" (e.g., CMP region) of the upper surface of the polishing pad.
FIG. 5*b* is the sectional view of FIG. 5*a* illustrating a semiconductor wafer undergoing a CMP operation using the polishing pad having the "slanted upwardly" radial profile indicated in FIG. 5*a;*
FIG. 5*c* is a side elevation view (i.e., a profile) of the semiconductor wafer following the CMP operation illustrated in FIG. 5*b*, wherein a polished surface of the semiconductor wafer is curved outwardly (i.e., made convex) as a result of the CMP operation using the polishing pad having the "slanted upwardly" radial profile indicated in FIG. 5*a;*
FIG. 6*a* is the sectional view of FIG. 4 wherein the upper surface of the polishing pad has a radial profile within the selected region which is "flat" relative to the substantially planar surface of the platen.
FIG. 6*b* is the sectional view of FIG. 6*a* illustrating a semiconductor wafer undergoing a CMP operation using the polishing pad having the "flat" radial profile indicated in FIG. 6*a;*
FIG. 6*c* is a side elevation view (i.e., a profile) of the semiconductor wafer of FIG. 6*b* following the CMP operation illustrated in FIG. 6*b*, wherein a polished surface of the semiconductor wafer is substantially planar as a result of the CMP operation using the polishing pad having the "flat" radial profile indicated in FIG. 6*a;*
FIG. 7*a* is the sectional view of FIG. 4 wherein the upper surface of the polishing pad has a radial profile within the selected region which is "slanted downwardly" in a radial direction from the rotational axis of the platen.
FIG. 7*b* is the sectional view of FIG. 7*a* illustrating a semiconductor wafer undergoing a CMP operation using the polishing pad having the "slanted downwardly" radial profile indicated in FIG. 7*a;*
FIG. 7*c* is a side elevation view (i.e., a profile) of the semiconductor wafer of FIG. 7*b* following the CMP operation illustrated in FIG. 7*b*, wherein a polished surface of the semiconductor wafer is curved inwardly (i.e., made concave) as a result of the CMP operation using the polishing pad having the "slanted downwardly" radial profile indicated in FIG. 7*a;*

FIG. 5*a* is the sectional view of FIG. 4 illustrating a radial profile of the upper surface of the polishing pad 14 wherein a height "$h_3$" of the upper surface of polishing pad 14 (i.e., polishing pad 14*b*) above the substantially planar surface of platen 12 at inner diameter "I.D." of polishing pad 14*b* is less than a height "$h_4$" of the upper surface of polishing pad 14 above the substantially planar surface of platen 12 at outer diameter "O.D." of polishing pad 14*b*.

FIG. 5*b* is the sectional view of FIG. 5*a* illustrating semiconductor wafer 20 undergoing a CMP operation using polishing pad 14 having the radial profile indicated in FIG. 5*a*. During the CMP operation, platen 12 rotates about rotational axis 22, wafer chuck 16 rotates about rotational axis 24, and a force "F" exerted between wafer chuck 16 and platen 12 presses a surface 36 of semiconductor wafer 20 against the slurry-laden upper surface of polishing pad 14 (i.e., polishing pad 14*b*). Force "F" compresses polishing pad 14 during the CMP operation. As a result of compressive force "F", the upper surface of polishing pad 14 is shown "flat" in FIG. 5*b*.

During the CMP operation, polishing takes place within a selected region of the upper surface of polishing pad 14. In exemplary CMP apparatus 10, the selected region is the upper surface of polishing pad 14*b*, encircling rotational axis 22 and extending between inner diameter "I.D." of polishing pad 14*b* and outer diameter "O.D." of polishing pad 14*b*. Inner diameter "I.D." of polishing pad 14*b* is defined by a first radial distance from rotational axis 22, and outer diameter "O.D." of polishing pad 14*b* is defined by a second radial distance from rotational axis 22. Referring back to FIG. 5*a*, the radial profile of the upper surface of polishing pad 14 within the selected region is "slanted upwardly" from the first radial distance defining "I.D." to the second radial distance defining "O.D.".

FIG. 5*c* is a side elevation view (i.e., a profile) of semiconductor wafer 20 following the CMP operation illustrated in FIG. 5*b*, wherein polished surface 36 of semiconductor wafer 20 is curved outwardly (i.e., made convex) as a result of the CMP operation using polishing pad 14 having the radial profile indicated in FIG. 5*a*. FIGS. 5*a–c* thus illustrate that performing CMP upon a surface of a wafer within a region of the upper surface of a polishing pad extending between first and second radial distances from the rotational axis of the platen, wherein the polishing pad has a profile which is "slanted upwardly" in a radial direction between the first and second radial distances as shown in FIG. 5*a*, results in a convex polished wafer surface.

FIG. 6*a* is the sectional view of FIG. 4 illustrating a radial profile of the upper surface of the polishing pad 14 wherein height "$h_3$" of the upper surface of polishing pad 14 (i.e., polishing pad 14*b*) above the substantially planar surface of platen 12 at inner diameter "I.D." is equal to height "$h_4$" of the upper surface of polishing pad 14 above the substantially planar surface of platen 12 at outer diameter "O.D." The radial profile of the upper surface of the polishing pad 14 in FIG. 6*a* is "flat" relative to the substantially planar surface of platen 12. FIG. 6*b* is the sectional view of FIG. 6*a* illustrating surface 36 of semiconductor wafer 20 undergoing a CMP operation using polishing pad 14 having the "flat" radial profile indicated in FIG. 6*a*. Force "F" exerted between wafer chuck 16 and platen 12 compresses polishing pad 14 during the CMP operation.

FIG. 6*c* is a side elevation view of semiconductor wafer 20 following the CMP operation illustrated in FIG. 6*b*. As a result of the CMP operation using polishing pad 14 having the "flat" radial profile indicated in FIG. 6*a*, polished surface 36 of semiconductor wafer 20 is substantially planar. FIGS. 6*a–c* thus illustrate that performing CMP upon a surface of a wafer within a region of the upper surface of a polishing pad extending between first and second radial distances from the rotational axis of the platen, wherein the polishing pad has a profile which is "flat" in a radial direction between the first and second radial distances as shown in FIG. 6*a*, results in a substantially planar wafer surface.

FIG. 7*a* is the sectional view of FIG. 4 illustrating a radial profile of the upper surface of the polishing pad 14 wherein height "$h_3$" of the upper surface of polishing pad 14 (i.e., polishing pad 14*b*) above the substantially planar surface of platen 12 at inner diameter "I.D." is greater than height "$h_4$" of the upper surface of polishing pad 14 above the substantially planar surface of platen 12 at outer diameter "O.D.". The profile of the upper surface of the polishing pad 14 in FIG. 7*a* is "slanted downwardly" in a radial direction relative to the substantially planar surface of platen 12.

FIG. 7*b* is the sectional view of FIG. 7*a* illustrating surface 36 of semiconductor wafer 20 undergoing a CMP operation using polishing pad 14 having a profile which is "slanted downwardly" in a radial direction as indicated in FIG. 6*a*. Force "F" exerted between wafer chuck 16 and platen 12 compresses polishing pad 14 during the CMP operation. As a result of compressive force "F" the upper surface of polishing pad 14 is shown "flat" in FIG. 7*b*.

FIG. 7*c* is a side elevation view of semiconductor wafer 20 following the CMP operation illustrated in FIG. 7*b*. As a result of the CMP operation of FIG. 7*b* using polishing pad 14 having a profile which is "slanted downwardly" in a radial direction as indicated in FIG. 7*a*, polished surface 36 of semiconductor wafer 20 is curved inwardly (i.e., made concave). FIGS. 7*a–c* illustrate that performing CMP upon a surface of a wafer within a region of the upper surface of a polishing pad extending between first and second radial distances from the rotational axis of the platen, wherein the polishing pad has a profile which is "slanted downwardly" in a radial direction between the first and second radial distances as shown in FIG. 7*a*, results in a concave wafer surface. The concave wafer surface of FIG. 7*c* is based upon experimental results obtained by performing CMP according to FIGS. 7*a–b*.

Figure 3:
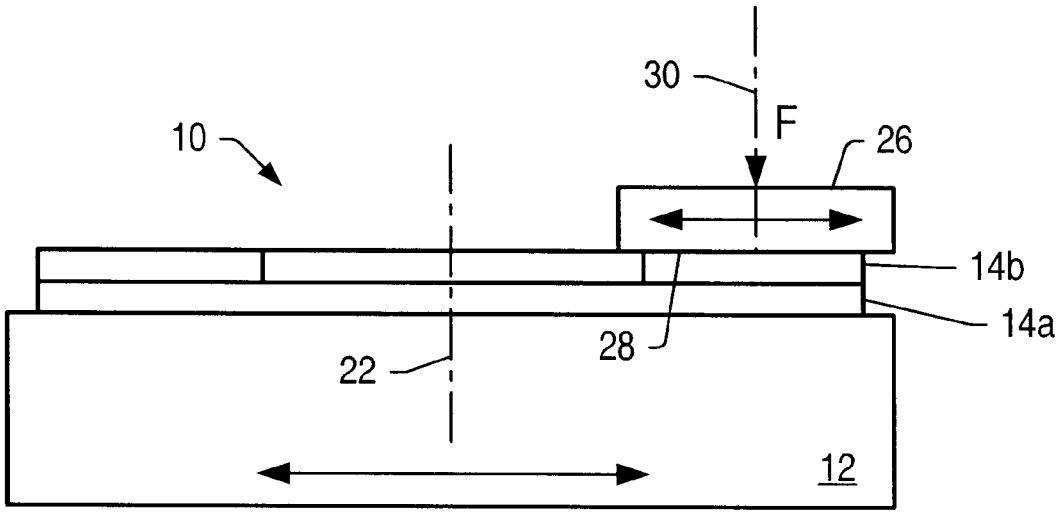
Fig. 3 (Prior Art)
FIG. 3 is a side elevation view of the CMP apparatus of FIG. 1 wherein the polishing pad is undergoing an exemplary conditioning operation, and wherein contact between an abrasive surface and the upper surface of the polishing pad causes a portion of the upper surface of the polishing pad to be abraded.
Figure 8C:
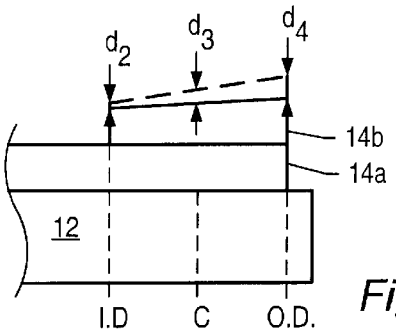
FIG. 8*c* is the sectional view of FIG. 4 illustrating the radial profile of the upper surface of the polishing pad of FIG. 8*a* following the conditioning operation illustrated in FIG. 8*b,* wherein the extent to which the radial profile of the upper surface of the polishing pad is "slanted upwardly" is reduced due to the fact that more material is removed from an outer radial portion of the selected region than from an inner radial portion of the selected region.

FIGS. 8*a–g*, 9*a–g*, and 10*a–g* will now be used to describe relationships between the positioning of pad conditioner 26 relative to polishing pad 14 during a conditioning operation (see FIG. 3) and resulting changes in the radial profile of the upper surface of polishing pad 14. FIG. 8*a* is the sectional view of FIG. 4 illustrating a radial profile of the upper surface of the polishing pad 14 wherein a height "$h_3$" of the upper surface of polishing pad 14 (i.e., polishing pad 14*b*) above the substantially planar surface of platen 12 at inner diameter "I.D." is less than a height "$h_4$" of the upper surface of polishing pad 14 above the substantially planar surface of platen 12 at outer diameter "O.D.". The profile of the upper surface of the polishing pad 14 in FIG. 8*a* is "slanted upwardly" in a radial direction relative to the substantially planar surface of platen 12 as described above.

Figure 8B:
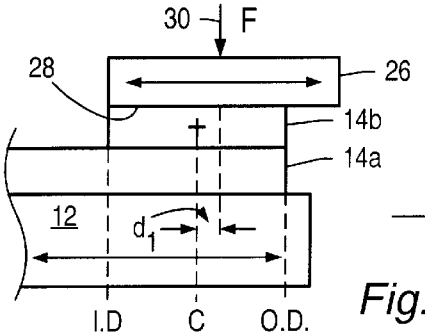
FIG. 8*b* is the sectional view of FIG. 8*a* illustrating the polishing pad undergoing a conditioning operation wherein a radial distance between a rotational axis of an abrasive surface contacting the upper surface of the polishing pad is made greater than a radial distance midway between the first and second radial distances defining the selected region.
Figure 8E:
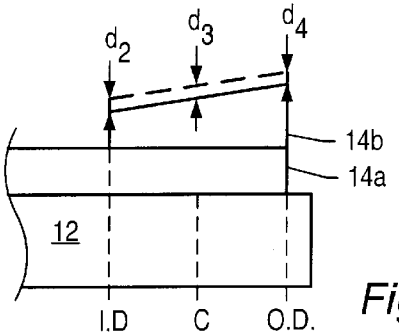
FIG. 8*e* is the sectional view of FIG. 4 illustrating the radial profile of the upper surface of the polishing pad of FIG. 8*a* following the conditioning operation illustrated in FIG. 8*d*, wherein the "slanted upwardly" radial profile of the upper surface of the polishing pad is not changed due to the fact that equal amounts of material are removed from the inner and outer portions of the selected region.
Figure 8D:
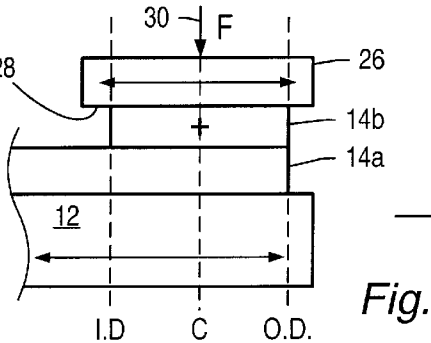
FIG. 8*d* is the sectional view of FIG. 8*a* illustrating the polishing pad undergoing a conditioning operation wherein a radial distance between a rotational axis of the abrasive surface contacting the upper surface of the polishing pad is made equal to the radial distance midway between the first and second radial distances defining the selected region.
Figure 8G:
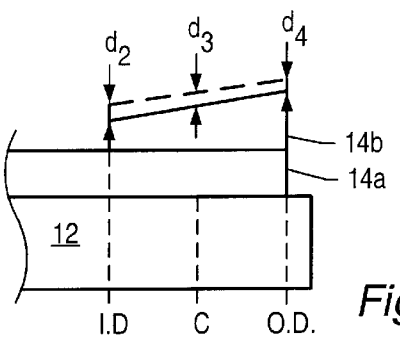
FIG. 8*g* is the sectional view of FIG. 4 illustrating the radial profile of the upper surface of the polishing pad of FIG. 8*a* following the conditioning operation illustrated in FIG. 8*f*, wherein the extent to which the radial profile of the upper surface of the polishing pad is "slanted upwardly" is increased due to the fact that more material is removed from the inner radial portion of the selected region than from the outer radial portion of the selected region.
Figure 8F:
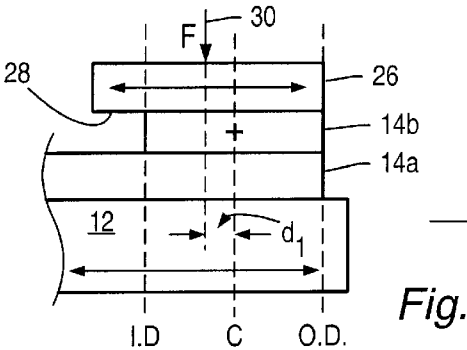
FIG. 8*f* is the sectional view of FIG. 8*a* illustrating the polishing pad undergoing a conditioning operation wherein a radial distance between a rotational axis of the abrasive surface contacting the upper surface of the polishing pad is made less than the radial distance midway between the first and second radial distances defining the selected region.
Figure 8A:
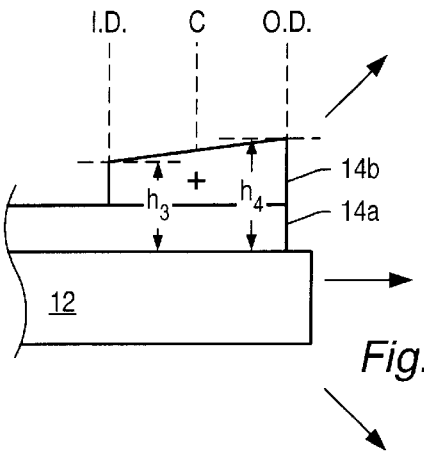
FIG. 8*a* is the sectional view of FIG. 4 wherein the upper surface of the polishing pad has a radial profile within the selected region which is "slanted upwardly" in a radial direction from the rotational axis of the platen.

FIG. 8*b* is the sectional view of FIG. 8*a* illustrating polishing pad 14 (i.e., polishing pad 14*b*) undergoing a conditioning operation using pad conditioner 26. Pad conditioner 26 is disk-shaped and has an outer diameter larger than the distance between outer diameter "O.D." and the inner diameter "I.D." of polishing pad 14*b*. In FIG. 8*b*, rotational axis 30 of pad conditioner 26 is positioned a radial distance "$d_1$" farther from rotational axis 22 of platen 12 than center line "C" of polishing pad 14*b* as shown in FIG. 8*b*.

During the conditioning operation, platen 12 is rotated about rotational axis 22, pad conditioner 26 is rotated about rotational axis 30, abrasive surface 28 of pad conditioner 26 is brought into contact with the upper surface of polishing pad 14*b*, and a force "F" is exerted between pad conditioner 26 and platen 12 as described above. Force "F" compresses polishing pad 14 during the conditioning operation. As a result of compressive force "F", the upper surface of polishing pad 14*b* is shown "flat" in FIG. 8*b*. A portion of the upper surface of polishing pad 14*b* is abraded during the conditioning operation as described above.

FIG. 8*c* is the sectional view of FIG. 4 illustrating the radial profile of the upper surface of polishing pad 14 of FIG. 8*a* following the conditioning operation illustrated in FIG. 8*b*. As shown in FIG. 8*c*, an elevational distance "$d_2$" relative to the substantially planar surface of platen 12 is removed from the upper surface of polishing pad 14*b* at inner diameter "I.D.". An elevational distance "$d_3$" is removed from the upper surface of polishing pad 14*b* at center line "C", and an elevational distance "$d_4$" is removed from the upper surface of polishing pad 14*b* at outer diameter "O.D.". As a result of the positioning of pad conditioner 26 relative to polishing pad 14*b* shown in FIG. 8*b*, a larger rotating surface area of abrasive surface 28 is in contact with the portion of the upper surface of polishing pad 14*b* between center line "C" and outer diameter "O.D.", resulting in elevational distance "$d_4$" being greater than elevational distance "$d_2$". Elevational distance "$d_3$" at center line "C" midway between "I.D." and "O.D." normally has a value between the values of "$d_4$" and "$d_3$" as indicated in FIG. 8*c*.

As shown in FIG. 8*c*, the extent that the profile of the upper surface of the polishing pad 14 in FIG. 8*a* is "slanted upwardly" is reduced by the conditioning operation of FIG. 8*b*. FIGS. 8*a–c* thus serve to illustrate that performing a conditioning operation within a region of the upper surface of a polishing pad extending between first and second radial distances from the rotational axis of the platen, wherein the upper surface of polishing pad has a radial profile which is "slanted upwardly" prior to conditioning and the rotational axis of the polishing pad is positioned at a radial distance exceeding midway between the first and second radial distances, results in a reduction in the extent to which the radial profile of the upper surface of the polishing pad is "slanted upwardly". It is noted that if the conditioning operation is carried out for a sufficient length of time, the "slanted upwardly" radial profile of the upper surface of the polishing pad may be made "flat", and may even be changed to "slanted downwardly".

FIG. 8*d* is the sectional view of FIG. 8*a* illustrating polishing pad 14 (i.e., polishing pad 14*b*) undergoing a conditioning operation wherein rotational axis 30 of pad conditioner 26 is positioned a radial distance from rotational axis 22 equal to a distance midway between inner diameter "I.D." and outer diameter "O.D." (i.e., along center line "C") of polishing pad 14*b*. Force "F" compresses polishing pad 14 during the conditioning operation as described above. As a result of compressive force "F", the upper surface of polishing pad 14*b* is shown "flat" in FIG. 8*d*.

FIG. 8*e* is the sectional view of FIG. 4 illustrating the radial profile of the upper surface of polishing pad 14 of FIG. 8*a* following the conditioning operation illustrated in FIG. 8*d*. Due to the positioning of pad conditioner 26 relative to polishing pad 14*b* shown in FIG. 8*d*, equal amounts of the rotating surface area of abrasive surface 28 are in contact with a first portion of the upper surface of polishing pad 14*b* between inner diameter "I.D." and center line "C", and a second portion of the upper surface of polishing pad 14*b* between center line "C" and outer diameter "O.D.". As a result, elevational distance "$d_4$", removed at outer diameter "O.D.", is substantially equal to elevational distance "$d_2$" removed at inner diameter "I.D.". Elevational distance "$d_3$" at center line "C" midway between "I.D." and "O.D." normally has a value substantially equal to "$d_4$" and "$d_3$" as indicated in FIG. 8*e*.

As shown in FIG. 8*e*, the extent that the profile of the upper surface of the polishing pad 14 in FIG. 8*a* is "slanted upwardly" is not changed by the conditioning operation of FIG. 8*d*. FIGS. 8*a*, 8*d*, and 8*e* thus serve to illustrate that performing a conditioning operation within a region of the upper surface of a polishing pad extending between first and second radial distances from the rotational axis of the platen, wherein the upper surface of polishing pad has a radial profile which is "slanted upwardly" prior to conditioning and the rotational axis of the polishing pad is positioned at a radial distance equal to a distance midway between the first and second radial distances, does not change the extent to which the radial profile of the upper surface of the polishing pad is "slanted upwardly".

FIG. 8*f* is the sectional view of FIG. 8*a* illustrating polishing pad 14 (i.e., polishing pad 14*b*) undergoing a conditioning operation wherein rotational axis 30 of pad conditioner 26 is positioned a radial distance "$d_1$" closer to rotational axis 22 of platen 12 than center line "C" of polishing pad 14*b*. Force "F" compresses polishing pad 14 during the conditioning operation as described above. As a result of compressive force "F", the upper surface of polishing pad 14*b* is shown "flat" in FIG. 8*f*.

FIG. 8*g* is the sectional view of FIG. 4 illustrating the radial profile of the upper surface of polishing pad 14 of FIG. 8*a* following the conditioning operation illustrated in FIG. 8*f*. As a result of the positioning of pad conditioner 26 relative to polishing pad 14*b* shown in FIG. 8*f*, a greater amount of the rotating surface area of abrasive surface 28 is in contact with the portion of the upper surface of polishing pad 14*b* between inner diameter "I.D." and center line "C", resulting in elevational distance "$d_4$", removed at outer diameter "O.D.", being substantially less than elevational distance "$d_2$" removed at inner diameter "I.D.". Elevational distance "$d_3$" at center line "C" midway between "I.D." and "O.D." normally has a value between the values of "$d_4$" and "$d_2$38 as indicated in FIG. 8*g*.

As shown in FIG. 8*g*, the extent that the profile of the upper surface of the polishing pad 14 in FIG. 8*a* is "slanted upwardly" is increased by the conditioning operation of FIG. 8*f*. FIGS. 8*a*, 8*f*, and 8*g* thus serve to illustrate that performing a conditioning operation within a region of the upper surface of a polishing pad extending between first and second radial distances from the rotational axis of the platen, wherein the upper surface of polishing pad has a radial profile which is "slanted upwardly" prior to conditioning and the rotational axis of the polishing pad is positioned at a radial distance less than a distance midway between the first and second radial distances, results in an increase in the extent to which the radial profile of the upper surface of the polishing pad is "slanted upwardly".

Figure 9A:
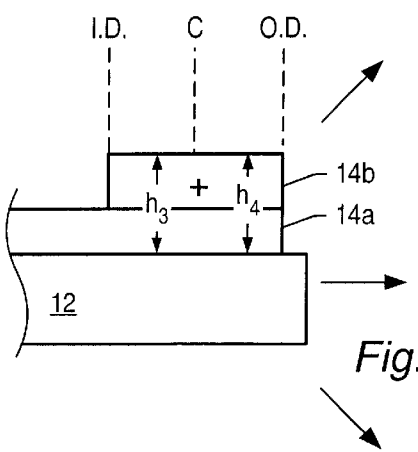
FIG. 9*a* is the sectional view of FIG. 4 wherein the upper surface of the polishing pad has a radial profile within the selected region which is "flat" relative to the substantially planar surface of the platen.

FIG. 9*a* is the sectional view of FIG. 4 illustrating a radial profile of the upper surface of the polishing pad 14 wherein height "$h_3$" of the upper surface of polishing pad 14 (i.e., polishing pad 14*b*) above the substantially planar surface of platen 12 at inner diameter "I.D." is substantially equal to height "$h_4$" of the upper surface of polishing pad 14 above the substantially planar surface of platen 12 at outer diameter "O.D.". The profile of the upper surface of the polishing pad 14 in FIG. 9*a* is "flat" in a radial direction relative to the substantially planar surface of platen 12 as described above.

Figure 9B:
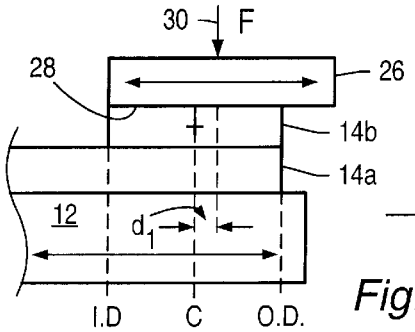
FIG. 9*b* is the sectional view of FIG. 9*a* illustrating the polishing pad undergoing a conditioning operation wherein a radial distance between a rotational axis of an abrasive surface contacting the upper surface of the polishing pad is made greater than a radial distance midway between the first and second radial distances defining the selected region.

FIG. 9*b* is the sectional view of FIG. 9*a* illustrating polishing pad 14 (i.e., polishing pad 14*b*) undergoing a conditioning operation wherein rotational axis 30 of pad conditioner 26 is positioned a radial distance "$d_1$" farther from rotational axis 22 of platen 12 than center line "C" of polishing pad 14*b*. Force "F" compresses polishing pad 14 during the conditioning operation as described above.

Figure 9C:
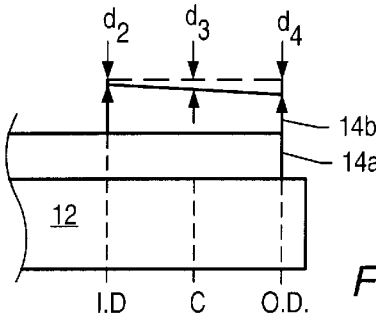
FIG. 9*c* is the sectional view of FIG. 4 illustrating the radial profile of the upper surface of the polishing pad of FIG. 9*a* following the conditioning operation illustrated in FIG. 9*b*, wherein the "flat" radial profile of the upper surface of the polishing pad is changed to "slanted downwardly" due to the fact that more material is removed from the outer radial portion of the selected region than from the inner radial portion of the selected region.

FIG. 9*c* is the sectional view of FIG. 4 illustrating the radial profile of the upper surface of polishing pad 14 of FIG. 9*a* following the conditioning operation illustrated in FIG. 9*b*. A larger amount of the rotating surface area of abrasive surface 28 is in contact with the portion of the upper surface of polishing pad 14*b* between center line "C" and outer diameter "O.D.". As a result, elevational distance "$d_4$" removed at outer diameter "O.D." is greater than elevational distance "$d_2$" removed at inner diameter "I.D.". Elevational distance "$d_3$" at center line "C" midway between "I.D." and "O.D." normally has a value between the values of "$d_4$" and "$d_2$" as indicated in FIG. 9*c*.

As shown in FIG. 9*c*, the "flat" radial profile of the upper surface of the polishing pad 14 in FIG. 9*a* is changed to "slanted downwardly" by the conditioning operation of FIG. 9*b*. FIGS. 9*a–c* thus serve to illustrate that performing a conditioning operation within a region of the upper surface of a polishing pad extending between first and second radial distances from the rotational axis of the platen, wherein the upper surface of polishing pad has a radial profile which is "flat" prior to conditioning and the rotational axis of the polishing pad is positioned at a radial distance exceeding midway between the first and second radial distances, results in a change in the radial profile of the upper surface of the polishing pad to "slanted downwardly".

Figure 9D:
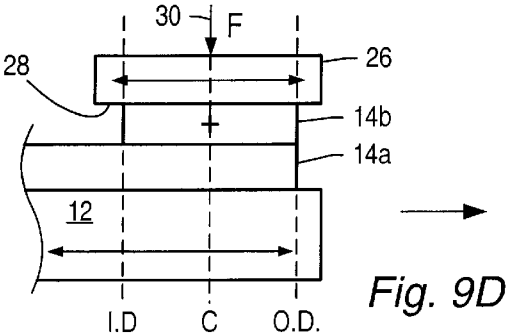
FIG. 9*d* is the sectional view of FIG. 9*a* illustrating the polishing pad undergoing a conditioning operation wherein a radial distance between a rotational axis of an abrasive surface contacting the upper surface of the polishing pad is made equal to the radial distance midway between the first and second radial distances defining the selected region.

FIG. 9*d* is the sectional view of FIG. 9*a* illustrating polishing pad 14 (i.e., polishing pad 14*b*) undergoing a conditioning operation wherein rotational axis 30 of pad conditioner 26 is positioned a radial distance from rotational axis 22 equal to a distance midway between inner diameter "I.D." and outer diameter "O.D." (i.e., along center line "C") of polishing pad 14*b*. Force "F" compresses polishing pad 14 during the conditioning operation as described above.

Figure 9E:
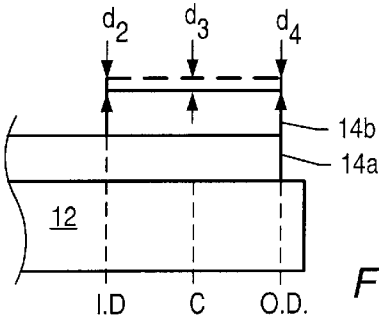
FIG. 9*e* is the sectional view of FIG. 4 illustrating the radial profile of the upper surface of the polishing pad of FIG. 9*a* following the conditioning operation illustrated in FIG. 9*d*, wherein the "flat" radial profile of the upper surface of the polishing pad is not changed due to the fact that equal amounts of material are removed from the inner and outer portions of the selected region.

FIG. 9*e* is the sectional view of FIG. 4 illustrating the radial profile of the upper surface of polishing pad 14 of FIG. 9*a* following the conditioning operation illustrated in FIG. 9*d*. Equal amounts of the rotating surface area of abrasive surface 28 are in contact with a first portion of the upper surface of polishing pad 14*b* between inner diameter "I.D." and center line "C", and a second portion of the upper surface of polishing pad 14*b* between center line "C" and outer diameter "O.D.". As a result, elevational distance "$d_4$", removed at outer diameter "O.D.",is substantially equal to elevational distance "$d_2$" removed at inner diameter "I.D.". Elevational distance "$d_3$" at center line "C" midway between "I.D." and "O.D." normally has a value substantially equal to "$d_4$" and "$d_2$" as indicated in FIG. 9*e*.

As shown in FIG. 9*e*, the "flat" radial profile of the upper surface of the polishing pad 14 in FIG. 9*a* is not changed by the conditioning operation of FIG. 9*d*. FIGS. 9*a*, 9*d*, and 9*e* thus serve to illustrate that performing a conditioning operation within a region of the upper surface of a polishing pad extending between first and second radial distances from the rotational axis of the platen, wherein the upper surface of polishing pad has a "flat" radial profile prior to conditioning and the rotational axis of the polishing pad is positioned at a radial distance equal to a distance midway between the first and second radial distances, does not change the "flat" radial profile of the upper surface of the polishing pad.

Figure 9F:
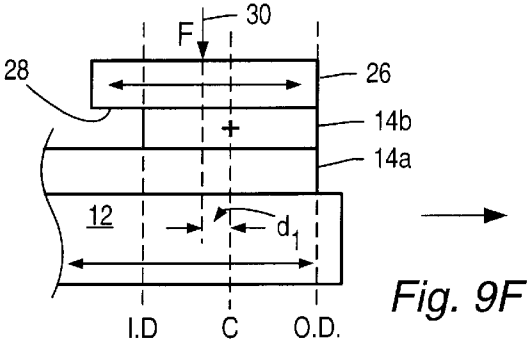
FIG. 9*f* is the sectional view of FIG. 9*a* illustrating the polishing pad undergoing a conditioning operation wherein a radial distance between a rotational axis of an abrasive surface contacting the upper surface of the polishing pad is made less than the radial distance midway between the first and second radial distances defining the selected region.

FIG. 9*f* is the sectional view of FIG. 9*a* illustrating polishing pad 14 (i.e., polishing pad 14*b*) undergoing a conditioning operation wherein rotational axis 30 of pad conditioner 26 is positioned a radial distance "$d_1$" closer to rotational axis 22 of platen 12 than center line "C" of polishing pad 14*b*. Force "F" compresses polishing pad 14 during the conditioning operation as described above.

Figure 9G:
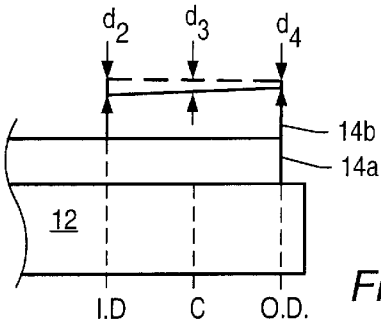
FIG. 9*g* is the sectional view of FIG. 4 illustrating the radial profile of the upper surface of the polishing pad of FIG. 9*a* following the conditioning operation illustrated in FIG. 9*f*, wherein the "flat" radial profile of the upper surface of the polishing pad is changed to "slanted upwardly" due to the fact that more material is removed from the inner radial portion of the selected region than from the outer radial portion of the selected region.

FIG. 9*g* is the sectional view of FIG. 4 illustrating the radial profile of the upper surface of polishing pad 14 of FIG. 9*a* following the conditioning operation illustrated in FIG. 9*f*. A greater amount of the rotating surface area of abrasive surface 28 is in contact with the portion of the upper surface of polishing pad 14*b* between inner diameter "I.D." and center line "C". As a result, elevational distance "$d_4$" removed at outer diameter "O.D." is substantially less than elevational distance "$d_2$" removed at inner diameter "I.D.". Elevational distance "$d_3$" at center line "C" midway between "I.D." and "O.D." normally has a value between the values of "$d_4$" and "$d_2$" as indicated in FIG. 9*g*.

As shown in FIG. 9*g*, the "flat" radial profile of the upper surface of the polishing pad 14 in FIG. 9*a* is changed to "slanted upwardly" by the conditioning operation of FIG. 9*f*. FIGS. 9*a*, 9*f*, and 9*g* thus serve to illustrate that performing a conditioning operation within a region of the upper surface of a polishing pad extending between first and second radial distances from the rotational axis of the platen, wherein the upper surface of polishing pad has a "flat" radial profile prior to conditioning and the rotational axis of the polishing pad is positioned at a radial distance less than a distance midway between the first and second radial distances, results in a change in the radial profile of the upper surface of the polishing pad to "slanted upwardly".

Figure 10C:
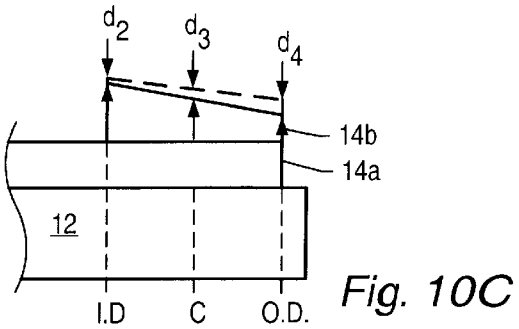
FIG. 10*c* is the sectional view of FIG. 4 illustrating the radial profile of the upper surface of the polishing pad of FIG. 10*a* following the conditioning operation illustrated in FIG. 10*b*, wherein the extent to which the radial profile of the upper surface of the polishing pad is "slanted downwardly" is increased due to the fact that more material is removed from an outer radial portion of the selected region than from an inner radial portion of the selected region.
Figure 10B:
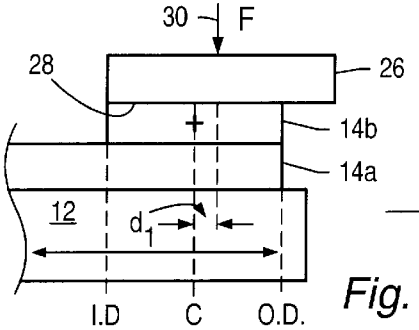
FIG. 10*b* is the sectional view of FIG. 10*a* illustrating the polishing pad undergoing a conditioning operation wherein a radial distance between a rotational axis of an abrasive surface contacting the upper surface of the polishing pad is made greater than a radial distance midway between the first and second radial distances defining the selected region.
Figure 10E:
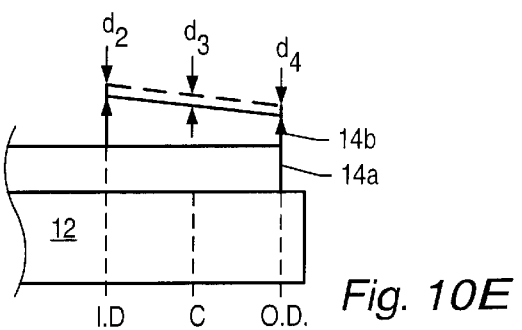
FIG. 10*e* is the sectional view of FIG. 4 illustrating the radial profile of the upper surface of the polishing pad of FIG. 10*a* following the conditioning operation illustrated in FIG. 10*d*, wherein the extent to which the radial profile of the upper surface of the polishing pad is "slanted downwardly" is not changed due to the fact that equal amounts of material are removed from the inner and outer portions of the selected region.
Figure 10D:
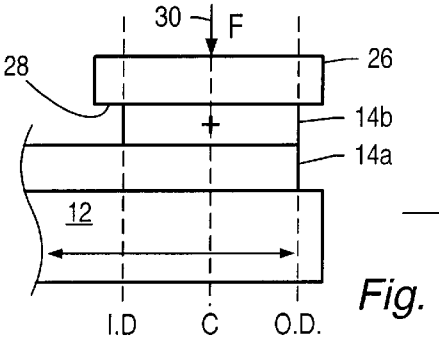
FIG. 10*d* is the sectional view of FIG. 10*a* illustrating the polishing pad undergoing a conditioning operation wherein a radial distance between a rotational axis of an abrasive surface contacting the upper surface of the polishing pad is made equal to the radial distance midway between the first and second radial distances defining the selected region.
Figure 10G:
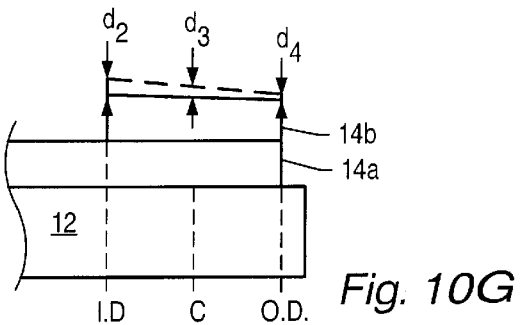
FIG. 10*g* is the sectional view of FIG. 4 illustrating the radial profile of the upper surface of the polishing pad of FIG. 10*a* following the conditioning operation illustrated in FIG. 10*f*, wherein the extent to which the radial profile of the upper surface of the polishing pad is "slanted downwardly" is reduced due to the fact that more material is removed from the inner radial portion of the selected region than from the outer radial portion of the selected region.
Figure 10F:
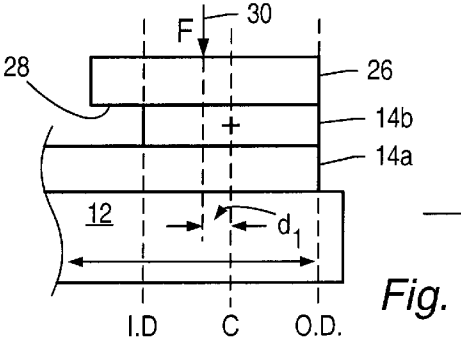
FIG. 10*f* is the sectional view of FIG. 10*a* illustrating the polishing pad undergoing a conditioning operation wherein a radial distance between a rotational axis of an abrasive surface contacting the upper surface of the polishing pad is made less than the radial distance midway between the first and second radial distances defining the selected region.
Figure 10A:
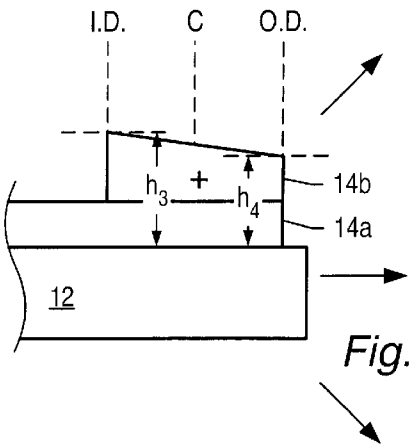
FIG. 10*a* is the sectional view of FIG. 4 wherein the upper surface of the polishing pad has a radial profile within the selected region which is "slanted downwardly" in a radial direction from the rotational axis of the platen.

FIG. 10*a* is the sectional view of FIG. 4 illustrating a radial profile of the upper surface of the polishing pad 14 wherein height "$h_3$" of the upper surface of polishing pad 14 (i.e., polishing pad 14*b*) above the substantially planar surface of platen 12 at inner diameter "I.D." is greater than height "$h_4$" of the upper surface of polishing pad 14 above the substantially planar surface of platen 12 at outer diameter "O.D.". The profile of the upper surface of the polishing pad 14 in FIG. 8*a* is "slanted downwardly" in a radial direction relative to the substantially planar surface of platen 12 as described above.

FIG. 10*b* is the sectional view of FIG. 10*a* illustrating polishing pad 14 (i.e., polishing pad 14*b*) undergoing a conditioning operation wherein rotational axis 30 of pad conditioner 26 is positioned a radial distance "$d_1$" farther from rotational axis 22 of platen 12 than center line "C" of polishing pad 14*b*. Force "F" compresses polishing pad 14 during the conditioning operation as described above. As a result of compressive force "F", the upper surface of polishing pad 14*b* is shown "flat" in FIG. 10*b*.

FIG. 10*c* is the sectional view of FIG. 4 illustrating the radial profile of the upper surface of polishing pad 14 of FIG. 10*a* following the conditioning operation illustrated in FIG. 10*b*. Due to the positioning of pad conditioner 26 as shown in FIG. 10*b*, elevational distance "$d_4$" removed at outer diameter "O.D." is greater than elevational distance "$d_2$" removed at inner diameter "I.D.". Elevational distance "$d_3$" at center line "C" midway between "I.D." and "O.D." normally has a value between the values of "$d_4$" and "$d_2$" as indicated in FIG. 10*c*.

As shown in FIG. 10*c*, the extent to which the radial profile of the upper surface of the polishing pad 14 in FIG. 109*a* is "slanted downwardly" is increased by the conditioning operation of FIG. 10*b*. FIGS. 10*a–c* thus serve to illustrate that performing a conditioning operation within a region of the upper surface of a polishing pad extending between first and second radial distances from the rotational axis of the platen, wherein the upper surface of polishing pad has a radial profile which is "slanted downwardly" prior to conditioning and the rotational axis of the polishing pad is positioned at a radial distance exceeding midway between the first and second radial distances, results in an increase in the extent to which the radial profile of the upper surface of the polishing pad to "slanted downwardly".

FIG. 10*d* is the sectional view of FIG. 10*a* illustrating polishing pad 14 (i.e., polishing pad 14*b*) undergoing a conditioning operation wherein rotational axis 30 of pad conditioner 26 is positioned a radial distance from rotational axis 22 equal to a distance midway between inner diameter "I.D." and outer diameter "O.D." (i.e., along center line "C") of polishing pad 14*b*. Force "F", exerted between pad conditioner 26 and platen 12 during the conditioning operation as described above, compresses polishing pad 14 during the conditioning operation.

FIG. 10*e* is the sectional view of FIG. 4 illustrating the radial profile of the upper surface of polishing pad 14 of FIG. 10*a* following the conditioning operation illustrated in FIG. 10*d*. Due to the positioning of pad conditioner 26 as shown in FIG. 10*d*, elevational distance "$d_4$" removed at outer diameter "O.D." is substantially equal to elevational distance "$d_2$" removed at inner diameter "I.D.". Elevational distance "$d_3$" at center line "C" midway between "I.D." and "O.D." normally has a value substantially equal to "$d_4$" and "$d_2$" as indicated in FIG. 10*e*.

As shown in FIG. 10*e*, the extent to which the radial profile of the upper surface of the polishing pad 14 in FIG. 10*a* is "slanted downwardly" is not changed by the conditioning operation of FIG. 10*d*. FIGS. 10*a*, 10*d*, and 10*e* thus serve to illustrate that performing a conditioning operation within a region of the upper surface of a polishing pad extending between first and second radial distances from the rotational axis of the platen, wherein the upper surface of polishing pad has a radial profile which is "slanted downwardly" prior to conditioning and the rotational axis of the polishing pad is positioned at a radial distance equal to a distance midway between the first and second radial distances, does not change the extent to which the radial profile of the upper surface of the polishing pad is "slanted downwardly".

FIG. 10*f* is the sectional view of FIG. 10*a* illustrating polishing pad 14 (i.e., polishing pad 14*b*) undergoing a conditioning operation wherein rotational axis 30 of pad conditioner 26 is positioned a radial distance "$d_1$" closer to rotational axis 22 of platen 12 than center line "C" of polishing pad 14*b*. Force "F" is exerted between pad conditioner 26 and platen 12 during the conditioning operation as described above. Force "F" compresses polishing pad 14 during the conditioning operation as described above. As a result of compressive force "F", the upper surface of polishing pad 14*b* is shown "flat" in FIG. 10*f*.

FIG. 10*g* is the sectional view of FIG. 4 illustrating the radial profile of the upper surface of polishing pad 14 of FIG. 10*a* following the conditioning operation illustrated in FIG. 10*f*. Due to the positioning of pad conditioner 26 as shown in FIG. 10*f*, elevational distance "$d_4$" removed at outer diameter "O.D." is substantially less than elevational distance "$d_2$" removed at inner diameter "I.D.". Elevational distance "$d_3$" at center line "C" midway between "I.D." and "O.D." normally has a value between the values of "$d_4$" and "$d_2$" as indicated in FIG. 10*g*.

As shown in FIG. 10*g*, the extent to which the radial profile of the upper surface of the polishing pad 14 in FIG. 10*a* is "slanted downwardly" is reduced by the conditioning operation of FIG. 10*f*. FIGS. 10*a*, 10*f*, and 10*g* thus serve to illustrate that performing a conditioning operation within a region of the upper surface of a polishing pad extending between first and second radial distances from the rotational axis of the platen, wherein the upper surface of polishing pad has radial profile which is "slanted downwardly" prior to conditioning and the rotational axis of the polishing pad is positioned at a radial distance less than a distance midway between the first and second radial distances, results in a reduction in the extent to which the radial profile of the upper surface of the polishing pad is "slanted downwardly". It is noted that if the conditioning operation is carried out for a sufficient length of time, the "slanted downwardly" radial profile of the upper surface of the polishing pad may be made "flat", and may even be changed to "slanted upwardly".

FIGS. 5*a–c*, 6*a–c*, and 7*a–c* show that it is possible to achieve a desired surface profile of semiconductor wafer 20 during a CMP operation using polishing pad 14 by effecting a corresponding desired radial profile of the upper surface of polishing pad 14. FIGS. 8*a–g*, 9*a–g*, and 10*a–g* show that it is possible to effect the desired radial profile of the upper surface of polishing pad 14 during a conditioning operation which precedes the CMP operation. During the conditioning, contact between abrasive surface 28 and the upper surface of polishing pad 14 causes the upper surface of polishing pad 14 to be abraded, and contact may be continued until the desired radial profile is achieved. In order to effect the desired radial profile of the upper surface of polishing pad 14 during the conditioning operation, it is necessary to: (i) determine the radial profile of the upper surface of polishing pad 14 prior to conditioning, and (ii) position pad conditioner 26 during the conditioning operation dependent upon the determined radial profile.

As described above, the CMP operation is carried out within a selected region of the upper surface of polishing pad 14. In exemplary CMP apparatus 10, the selected region is the upper surface of polishing pad 14*b*, encircling rotational axis 22 and extending between inner diameter "I.D." of polishing pad 14*b* and outer diameter "O.D." of polishing pad 14*b*. Inner diameter "I.D." of polishing pad 14*b* is defined by a first radial distance from rotational axis 22, and outer diameter "O.D." of polishing pad 14*b* is defined by a second radial distance from rotational axis 22.

The radial profile of the upper surface of polishing pad 14 prior to conditioning may be determined by measuring: (i) an first existing distance between the upper surface of polishing pad 14 (i.e., polishing pad 14*b*) and the substantially planar surface of platen 12 at the first radial distance from rotational axis 22, and (ii) an second existing distance between the upper surface of polishing pad 14 and the substantially planar surface of platen 12 at the second radial distance from rotational axis 22. Similarly, the desired radial profile of the upper surface of polishing pad 14 following conditioning may be characterized using: (i) a first desired distance between the upper surface of polishing pad 14 (i.e., polishing pad 14*b*) and the substantially planar surface of platen 12 at the first radial distance from rotational axis 22, and (ii) a second desired distance between the upper surface of polishing pad 14 and the substantially planar surface of platen 12 at the second radial distance from rotational axis 22.

When the difference between the second existing distance and the second desired distance is greater than a difference between the first existing distance and the first desired distance, the desired radial profile of the upper surface of polishing pad 14 may be achieved by positioning pad conditioner 26 such that the radial distance from rotational axis 30 of abrasive surface 28 to rotational axis 22 of platen 12 is greater than a radial distance midway between the first and second radial distances defining the selected region. In this case, a larger rotating surface area of abrasive surface 28 is in contact with the portion of the upper surface of polishing pad 14*b* between center line "C" and outer diameter "O.D." as described above, and elevational distance "$d_4$" removed at outer diameter "O.D." is greater than elevational distance "$d_2$" removed at inner diameter "I.D.". (See FIGS. 8*c*, 9*c*, and 10*c*).

When the difference between the second existing distance and the second desired distance is substantially equal to a difference between the first existing distance and the first desired distance, the desired radial profile of the upper surface of polishing pad 14 may be achieved by positioning pad conditioner 26 such that the radial distance from rotational axis 30 of abrasive surface 28 to rotational axis 22 of platen 12 is equal to the radial distance midway between the first and second radial distances defining the selected region. In this case, equal amounts of the rotating surface area of abrasive surface 28 are in contact with a first portion of the upper surface of polishing pad 14*b* between inner diameter "I.D." and center line "C", and a second portion of the upper surface of polishing pad 14*b* between center line "C" and outer diameter "O.D.". As a result, elevational distance "$d_4$" removed at outer diameter "O.D." is substantially equal to elevational distance "$d_2$" removed at inner diameter "I.D.". (See FIGS. 8*e*, 9*e*, and 10*e*).

When the difference between the second existing distance and the second desired distance is less than a difference between the first existing distance and the first desired distance, the desired radial profile of the upper surface of polishing pad 14 may be achieved by positioning pad conditioner 26 such that the radial distance from rotational axis 30 of abrasive surface 28 to rotational axis 22 of platen 12 is less than the radial distance midway between the first and second radial distances defining the selected region. In this case, a larger rotating surface area of abrasive surface 28 is in contact with the portion of the upper surface of polishing pad 14*b* between inner diameter "I.D." and center line "C" as described above, and elevational distance "$d_4$" removed at outer diameter "O.D." is less than elevational distance "$d_2$" removed at inner diameter "I.D.". (See FIGS. 8*g*, 9*g*, and 10*g*).

Additionally, a third existing distance between the upper surface of polishing pad 14 and the substantially planar surface of platen 12 may be measured at a radial distance from rotational axis 22 midway between the first and second radial distances defining the selected region. The third existing distance may be used to determine if polishing pad 14 is eligible for conditioning, or needs to be replaced. It has been empirically determined that conditioning polishing pad 14 to achieve a desired radial profile of the upper surface is most effective when the third existing distance, measured at center line "C" midway between "I.D." and "O.D.", is between the first and second existing distances. Conditioning to achieve a desired radial profile of the upper surface of polishing pad 14 is least effective when the third existing distance is not between the first and second existing distances. In this case, polishing pad 14 should be replaced.

Figure 11:
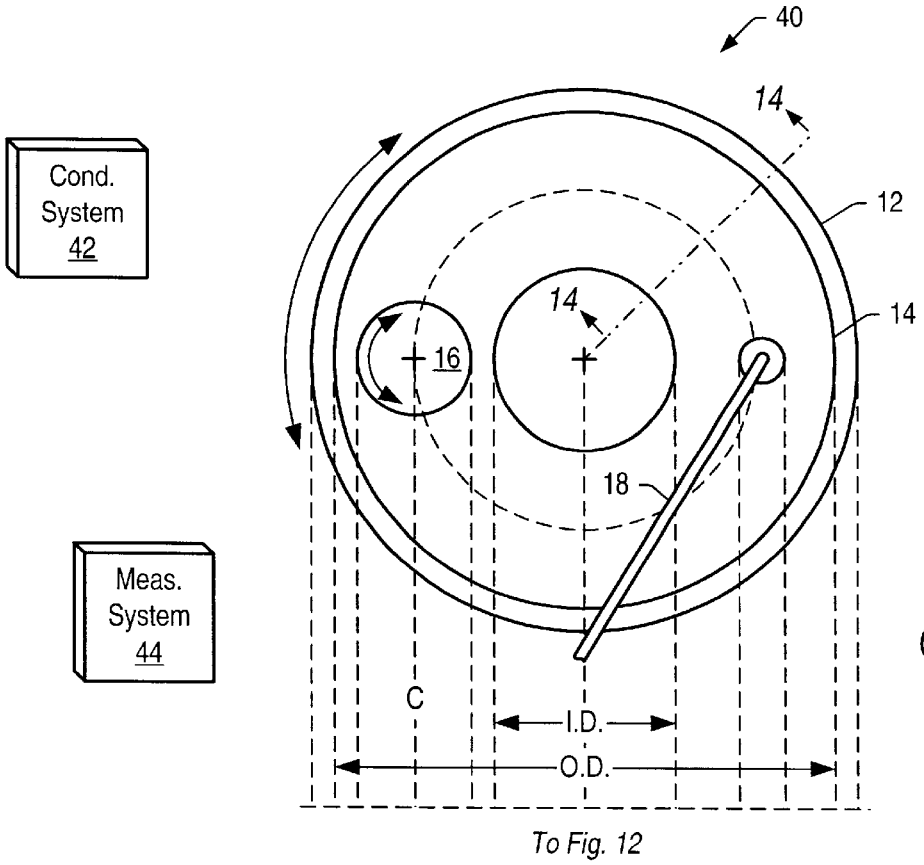
Fig. 11 (Prior Art)
FIG. 11 is a top plan view of one embodiment of a CMP apparatus in accordance with the present invention, wherein the CMP apparatus includes a polishing pad mechanically coupled to a substantially planar surface of a rotatable platen, a conditioning system for conditioning the polishing pad, and a measurement system for measuring distances between the upper surface of the polishing pad and the substantially planar surface of the platen.
Figure 12:
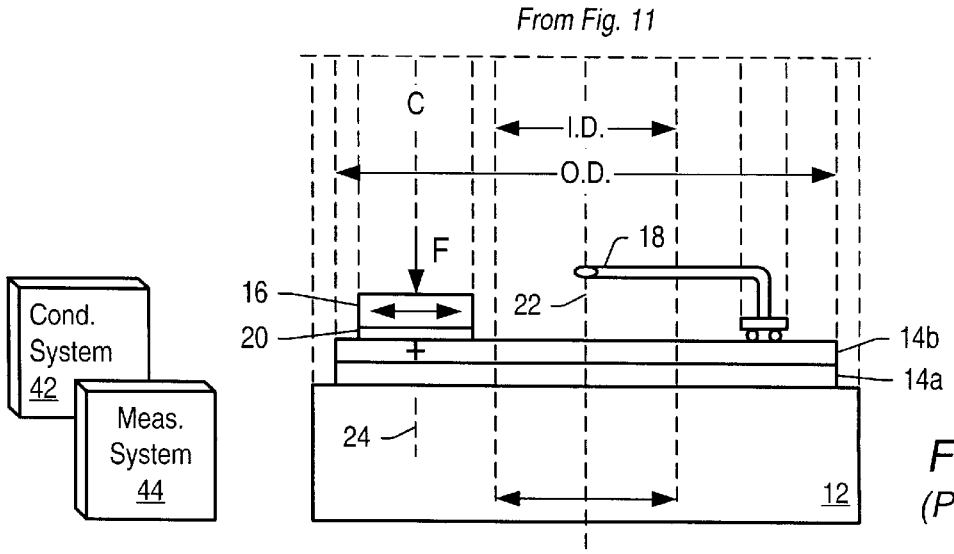
Fig. 12 (Prior Art)
FIG. 12 is a side elevation view of the CMP apparatus of FIG. 11.

FIG. 11 is a top plan view of one embodiment of a CMP apparatus 40 in accordance with the present invention, and FIG. 12 is a side elevation view of CMP apparatus 40. Elements of CMP apparatus 40 common to exemplary CMP apparatus 10 described above are labeled similarly. CMP apparatus 40 includes platen 12, polishing pad 14, wafer chuck 16, and slurry delivery system 18. CMP apparatus 40 also includes a conditioning system 42 used to condition polishing pad 14 and a measurement system 44 used to measured elevational distances between the upper surface of polishing pad 14 and the substantially planar surface of platen 12.

During a CMP operation conducted using CMP apparatus 40, polishing takes place within a selected region of the upper surface of polishing pad 14. The selected region is the upper surface of polishing pad 14*b*, encircling rotational axis 22 and extending between inner diameter "I.D." of polishing pad 14*b* and outer diameter "O.D." of polishing pad 14*b*. Inner diameter "I.D." of polishing pad 14*b* is defined by a first radial distance from rotational axis 22, and outer diameter "O.D." of polishing pad 14*b* is defined by a second radial distance from rotational axis 22.

Figure 13:
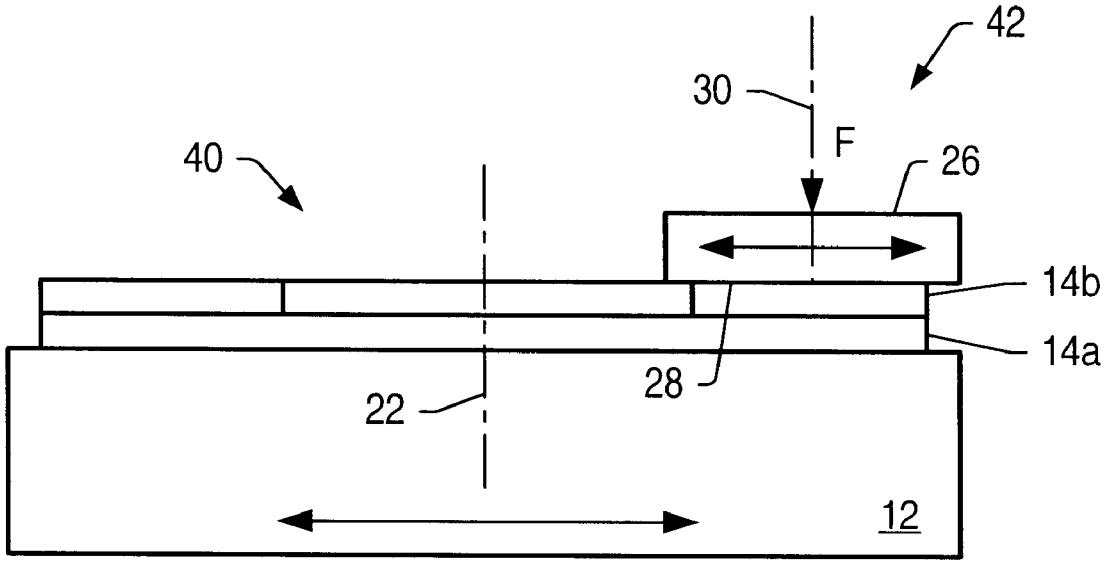
FIG. 13 is a side elevation view of the CMP apparatus of FIG. 11 wherein the polishing pad is undergoing a conditioning operation using the pad conditioner.

Conditioning system 42 includes pad conditioner 26 described above. FIG. 13 is a side elevation view of polishing pad 14*b* undergoing an exemplary conditioning operation using pad conditioner 26 of conditioning system 42. During conditioning, platen 12 is set into rotational motion about rotational axis 22, and pad conditioner 26 is set into rotational motion about rotational axis 30 normal to substantially planar abrasive surface 28. Abrasive surface 28 of pad conditioner 26 is brought into contact with the upper surface of polishing pad 14 (i.e., polishing pad 14*b*). As a result, a portion of the upper surface of polishing pad 14 is abraded (i.e., removed), along with any waste materials built up on the upper surface of polishing pad 14. Pad conditioner 26 may be mounted upon an arm adjacent to platen 12 such that pad conditioner 26 may be positioned over platen 12 when in use and removed from the space above platen 12 when not in use.

Figure 14A:
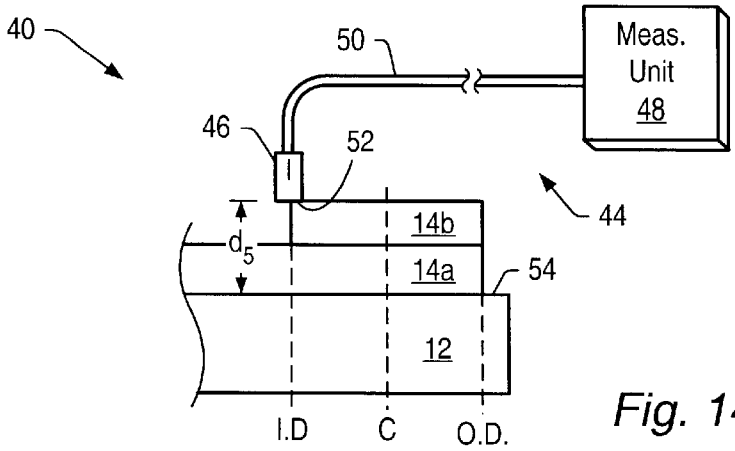
FIG. 14*a* is a sectional view of the CMP apparatus of FIG. 11 illustrating one embodiment of the measurement system, wherein the measurement system is being used to measure a distance between the upper surface of the polishing pad and the substantially planar surface of the platen at a first radial distance from a rotational axis of the rotatable platen, wherein the first radial distance and a second radial distance define a selected region of the upper surface of the polishing pad.
Figure 14B:
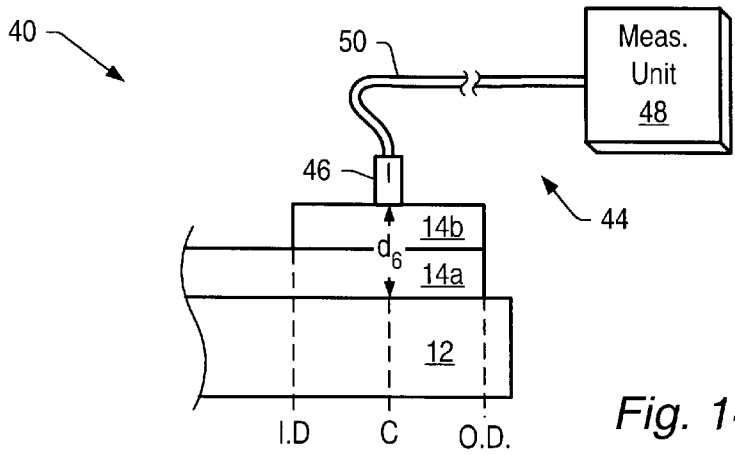
FIG. 14*b* is a sectional view of the CMP apparatus of FIG. 11, wherein the measurement system is being used to measure a distance between the upper surface of the polishing pad and the substantially planar surface of the platen midway between the first and second radial distances.
Figure 14C:
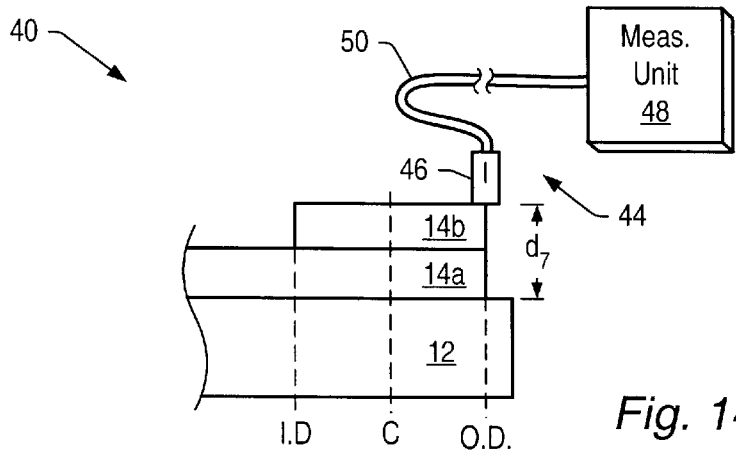
FIG. 14*c* is a sectional view of the CMP apparatus of FIG. 11, wherein the measurement system is being used to measure a distance between the upper surface of the polishing pad and the substantially planar surface of the platen at the second radial distance.

FIGS. 14*a–c* show measurement system 44 in operation. FIG. 14*a* is a sectional view of CMP apparatus 40 illustrating one embodiment of measurement system 44, wherein measurement system 44 is being used to measure a distance "$d_5$" between the upper surface of polishing pad 14 and the substantially planar surface of platen 12 at inner diameter "I.D." of polishing pad 14*b* (i.e., the first radial distance from rotational axis 22 defining the selected region). Measurement system 44 includes a sensor 46 connected to a measurement unit 48 by a cable 50. Sensor 46 produces a signal dependent upon a distance between a sensing surface 52 and substantially planar surface 54 of platen 12. Cable 50 transmits the signal produced by sensor 46 to measurement unit 48.

Measurement unit 48 may include a display device for displaying the distance between sensing surface 52 and substantially planar surface 54. Alternately, measurement system 48 may include signal conditioning circuitry, and may produce an output signal (e.g., an electrical voltage or current) proportional to the distance between sensing surface 52 and substantially planar surface 54. Measurement system 48 may produce the output signal at an output port configured for connecting to a device for measuring the signal (e.g., a voltmeter or ammeter).

Platen 12 may be formed from an electrically conductive metal (e.g., stainless steel), and polishing pad 14 may be made of an electrically non-conductive material (e.g., a polyurethane material or a polyurethane-impregnated polyester felt material). In this case, measurement system 44 may be a model KD-2300 position sensing system manufactured by Kaman Instrumentation Corp. (Colorado Springs, Colo.). Sensor 46 may include a coil of wire, and measurement system 44 may inductively measure a distance between sensing surface 52 and substantially planar surface 54 of platen 12 through electrically non-conductive polishing pad 14. Measurement system 48 may produce an electrical voltage proportional to the distance between sensing surface 52 and substantially planar surface 54 at the output port.

FIG. 14*b* is a sectional view of CMP apparatus 40, wherein measurement system 44 is being used to measure a distance "$d_6$" between the upper surface of polishing pad 14 and the substantially planar surface of platen 12 at center line "C" midway between inner diameter " I.D." and outer diameter "O.D." of polishing pad 14*b* (i.e., midway between the first and second radial distances from rotational axis 22 defining the selected region). FIG. 14*c* is a sectional view of CMP apparatus 40 wherein measurement system 44 is being used to measure a distance "$d_7$" between the upper surface of polishing pad 14 and the substantially planar surface of platen 12 at outer diameter "O.D." of polishing pad 14*b* (i.e., the second radial distance from rotational axis 22 defining the selected region).

Distance "$d_5$" represents the first existing distance between the upper surface of polishing pad 14 and the substantially planar surface of platen 12 at the first radial distance from rotational axis 22, and distance "$d_7$" represents the second distance between the upper surface of polishing pad 14 and the substantially planar surface of platen 12 at the second radial distance from rotational axis 22. Distances "$d_5$" and "$d_7$" measured prior to conditioning may be used to determine a "pre-conditioning" radial profile of the upper surface of polishing pad 14 as described above. It is also noted that distances "$d_5$" and "$d_7$" may be measured after conditioning in order to determine a "post-conditioning" radial profile of the upper surface of polishing pad 14 (e.g., to confirm that a desired radial profile of the upper surface of polishing pad 14 is achieved). Distance "$d_6$" represents the third existing distance between the upper surface of polishing pad 14 and the substantially planar surface of platen 12 described above, and may be used to determine if polishing pad 14 is eligible for conditioning or needs to be replaced.

It will be appreciated by those skilled in the art having the benefit of this disclosure that this invention is believed to be a system and method for achieving a desired semiconductor wafer surface profile via selective polishing pad conditioning. It is intended that the following claims be interpreted to embrace all such modifications and changes and, accordingly, the specification and drawings are to be regarded in an illustrative rather than a restrictive sense.

What is claimed is:

1. An apparatus for conditioning a polishing surface of a polishing pad mounted upon a platen that is rotatable about a rotational axis of the platen, the apparatus comprising:

means for measuring a distance between the polishing surface and the platen; and an abrasive surface rotatable about an axis central to and perpendicular to the abrasive surface, wherein the abrasive surface is brought into contact with the polishing surface such that the rotational axis of the abrasive surface is configured at a radial distance from the rotational axis of the platen dependent upon a measured distance between the polishing surface and the platen.

2. The apparatus as recited in claim 1, wherein the measuring means comprises a measuring system including a sensor coupled to a measurement unit.

3. The apparatus as recited in claim 2, wherein the sensor comprises a coil of wire, and wherein the measuring system inductively measures the distance between the polishing surface and the platen.

4. The apparatus as recited in claim 1, wherein the abrasive surface comprises abrasive particles embedded therein.

5. The apparatus as recited in claim 4, wherein the abrasive particles comprise diamond particles.

6. The apparatus as recited in claim 1, wherein the radial distance at which the abrasive surface is configured is between a first radial distance and a second radial distance from the rotational axis of the platen.

7. The apparatus as recited in claim 6, wherein the radial distance at which the abrasive surface is configured is closer to the first radial distance than the second radial distance if the polishing surface is brought in closer contact with the abrasive surface at the first radial distance than at the second radial distance.

8. The apparatus as recited in claim 6, wherein the radial distance at which the abrasive surface is configured is closer to the second radial distance than the first radial distance if the polishing surface is brought in closer contact with the abrasive surface at the second radial distance than the first radial distance.

9. The apparatus as recited in claim 6, wherein the rotational axis of the abrasive surface is radially moveable between the first radial distance and the second radial distance depending on the shape of the polishing surface relative to the platen.

* * * * *